US008465235B2

(12) United States Patent
Jenkins et al.

(10) Patent No.: US 8,465,235 B2
(45) Date of Patent: Jun. 18, 2013

(54) APPARATUS AND METHOD FOR FORMING ANNULAR GROOVES ON THE OUTER SURFACE OF A CABLE OR TUBE

(75) Inventors: Peter David Jenkins, Woodbridge (GB); Daniel Owen Jenkins, Woodbridge (GB)

(73) Assignee: Miniflex Limited, Framlingham (GB)

( * ) Notice: Subject to any disclaimer, the term of this patent is extended or adjusted under 35 U.S.C. 154(b) by 1028 days.

(21) Appl. No.: 11/988,658

(22) PCT Filed: Jul. 12, 2006

(86) PCT No.: PCT/GB2006/002576

§ 371 (c)(1),
(2), (4) Date: Jun. 25, 2009

(87) PCT Pub. No.: WO2007/007097

PCT Pub. Date: Jan. 18, 2007

(65) Prior Publication Data

US 2010/0021254 A1 Jan. 28, 2010

(30) Foreign Application Priority Data

Jul. 13, 2005 (GB) ..... 0514372.2

(51) Int. Cl.
*B23C 3/00* (2006.01)

(52) U.S. Cl.
USPC ..... 409/165; 409/167; 409/228; 72/71

(58) Field of Classification Search
USPC .... 409/165, 167, 169, 199, 200, 228; 82/162; 72/70, 71, 106, 110, 124, 125, 370.2, 370.21
See application file for complete search history.

(56) References Cited

U.S. PATENT DOCUMENTS

| | | | | |
|---|---|---|---|---|
| 3,572,074 | A * | 3/1971 | Holdup et al. | 72/77 |
| 3,656,331 | A * | 4/1972 | Kuypers et al. | 72/77 |
| 3,735,616 | A | 5/1973 | Donelan | |
| 4,435,968 | A | 3/1984 | Roderburg | |
| 4,514,997 | A * | 5/1985 | Zifferer | 72/68 |
| 2006/0053919 | A1 * | 3/2006 | Siler et al. | 74/424.71 |

FOREIGN PATENT DOCUMENTS

| | | |
|---|---|---|
| EP | 0 765 214 | 5/2000 |
| JP | 61067523 | 4/1986 |
| SU | 1207657 A * | 1/1986 |

* cited by examiner

*Primary Examiner* — Daniel Howell
*Assistant Examiner* — Michael Vitale
(74) *Attorney, Agent, or Firm* — Holland & Bonzagni, P.C.; Mary R. Bonzagni, Esq.

(57) ABSTRACT

The present invention provides an apparatus (100) for forming circumferential grooves (14) in the exterior surface of a linear member (10), such as a tube. The grooves are formed by rotating a cylindrical cutting element (120) around the tube such that cutting means in the cylindrical cutting element form the grooves. One rotation of the cylindrical cutting element causes multiple grooves to be formed in the surface of the tubes.

11 Claims, 6 Drawing Sheets

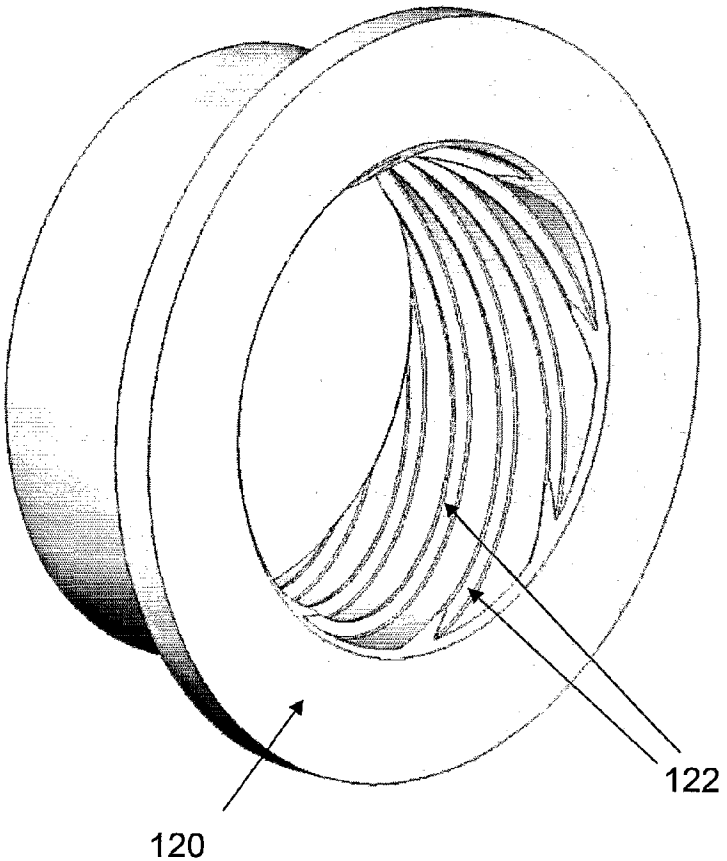
Figure 5a
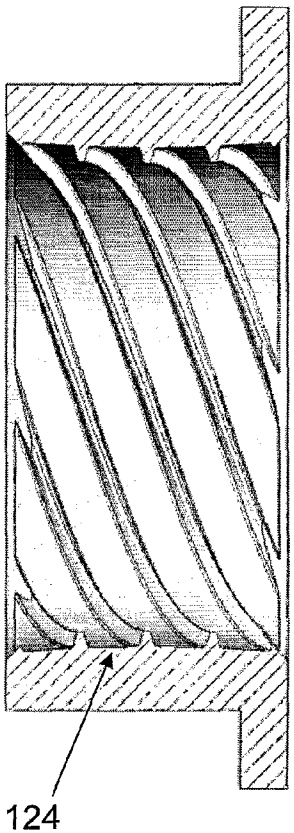
Figure 5b
Figure 5

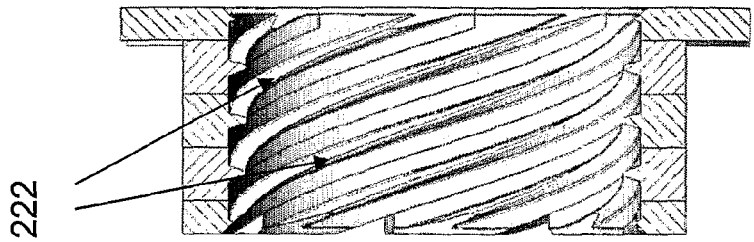
Figure 6c
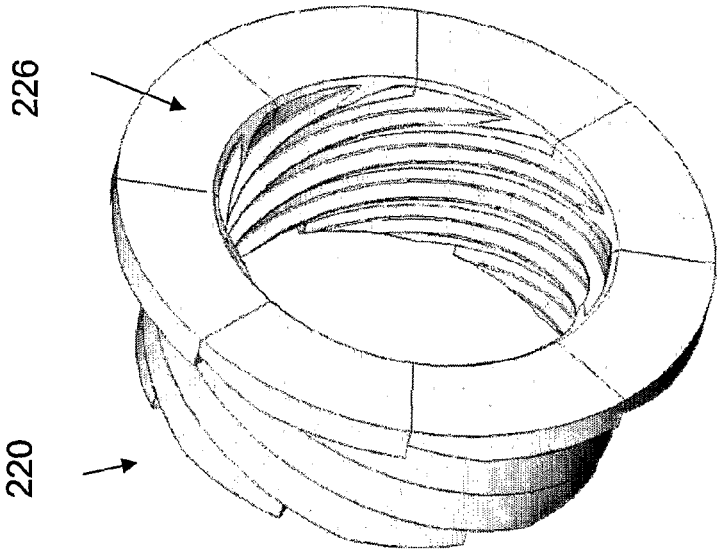
Figure 6b
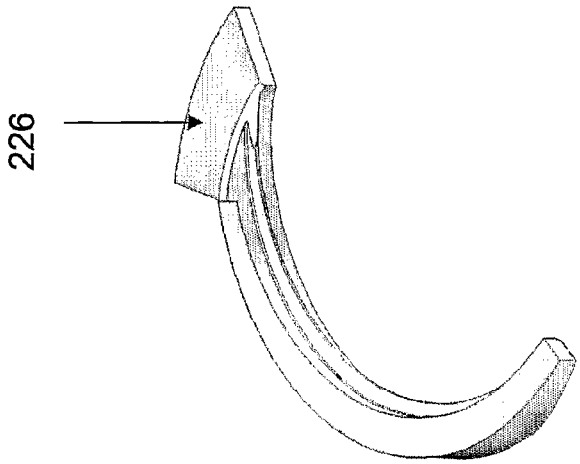
Figure 6a
Figure 6

APPARATUS AND METHOD FOR FORMING ANNULAR GROOVES ON THE OUTER SURFACE OF A CABLE OR TUBE

BACKGROUND a. Field of the Invention

The present invention relates to the processing of linear members such as cables or tubes, and in particular to apparatuses for and methods of processing linear members to form a series of annular grooves in their outer surfaces.

b. Related Art

EP 765 214 discloses an apparatus suitable for forming a series of parallel grooves in the outer wall of a smooth bore tube. The apparatus comprises three rollers which are disposed around the tube as it is passed through the apparatus. One or more of the rollers are grooved and the rotation of the grooved roller(s) forms the sequence of grooves within the outer surface of the tube.

One of the limitations of the apparatus disclosed in EP 765 214 is that the triangular arrangement of the rollers form an interstice through which the tube is passed. The geometry of this arrangement means that it is difficult to process small tubes, for example tubes having a diameter of 3 mm or less.

Our co-pending application GB 0421439.1, filed on 27 Sep. 2004, describes an apparatus in which a similar series of parallel grooves may be formed in the outer wall of a smooth bore tube. The apparatus comprises two opposed rollers, one or more of which may be grooved to form the grooves in the tube, between which a tube is passed in order to provide the grooving. Furthermore, two opposed positioning means are provided to maintain the position of the tube relative to the opposed rollers. This arrangement allows the two opposed rollers can be brought very close together, enabling grooves to be formed in small tubes, for example tubes having a diameter of less than 3 mm.

One of the disadvantages of the approaches disclosed in both EP 765 214 and GB 0421439.1, is that in order to form grooves small diameter tubes, it is necessary to use small bearings to rotate the rollers that form the grooves. In order to achieve processing speeds that make the production of grooved tubing economically viable it is necessary to rotate these bearings at very high speed, for example in excess of 10 000 rpm. Prolonged operation at these sorts of speeds leads to a significant decrease in the operating lifetime of the bearings. It has believed that the centrifugal forces cause the lubricant within the bearings to be expelled past the seals, which leads to the premature failure of the bearings. The design of the apparatus described in both EP 765 214 and GB 0421439.1 necessitates the use of small bearings that prevent the use of active cooling and lubrication measures that could prolong the operational lifetime of the bearings.

SUMMARY OF THE INVENTION

According to a first aspect of the present invention there is provided an apparatus for forming a plurality of grooves in the outer surface of an elongate member, the apparatus comprising: a cylindrical cutter, the internal surface of the cylindrical cutter comprising a plurality of cutting means; first and second rotatable positioning means, the first and second rotatable positioning means configured, in use, to hold an elongate member against the internal surface of the cylindrical cutter; the cylindrical cutter being received within a cutter rotation means such that the rotation of the cutter rotation means causes the cylindrical cutter to rotate, the rotation of the cylindrical cutter, in use, causing the first and second rotatable positioning means and an elongate member held against the internal surface of the cylindrical cutter to rotate relative to the internal surface of the cylindrical cutter such that the elongate member is advanced through the cylindrical cutter and the plurality of cutting means form a plurality of grooves in the outer surface of the elongate member.

Such an arrangement provides a significant advantage, as the present invention causes the tube to be rotated inside a cylindrical cutter as opposed to known techniques wherein one or more cutters are rotated around the outside of a tube. The present invention enables the use of larger bearings, which can be lubricated and cooled hydraulically, for example by pumping cooled oil into the bearing. The larger bearings are also capable of prolonged operation at high speeds, for example in excess of 10000 rpm.

BRIEF DESCRIPTION OF THE DRAWINGS

FIG. 5 shows a schematic depiction of a first cylindrical cutter for use with an apparatus according to the present invention; and FIG. 6 shows a schematic depiction of a second cylindrical cutter for use with an apparatus according to the present invention.

DETAILED DESCRIPTION

Figure 1:
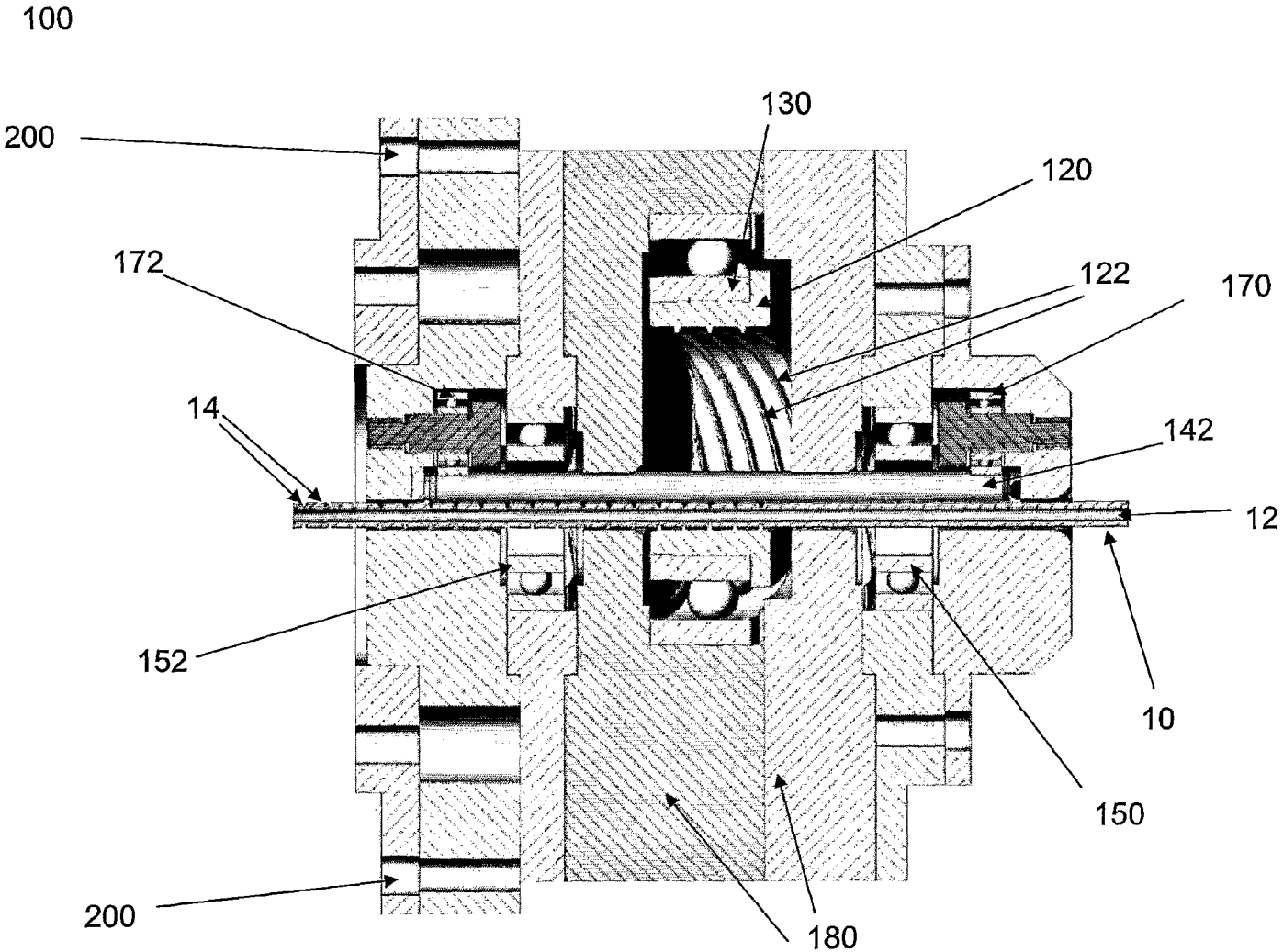
FIG. 1 shows a schematic depiction of a cross-section of an apparatus according to the present invention.
Figure 2:
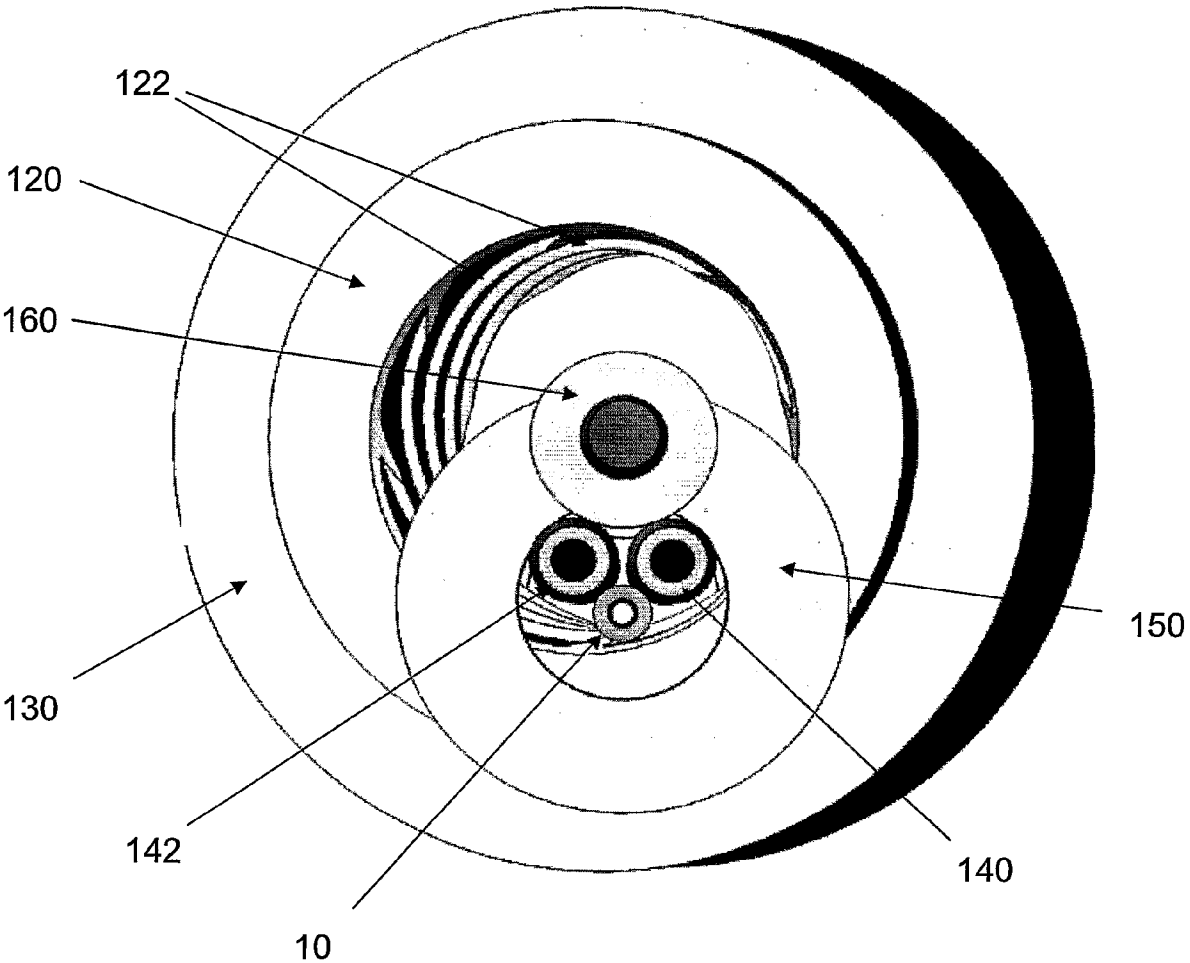
FIG. 2 shows a schematic depiction of a cut-away axial view of an apparatus according to the present invention.
Figure 3:
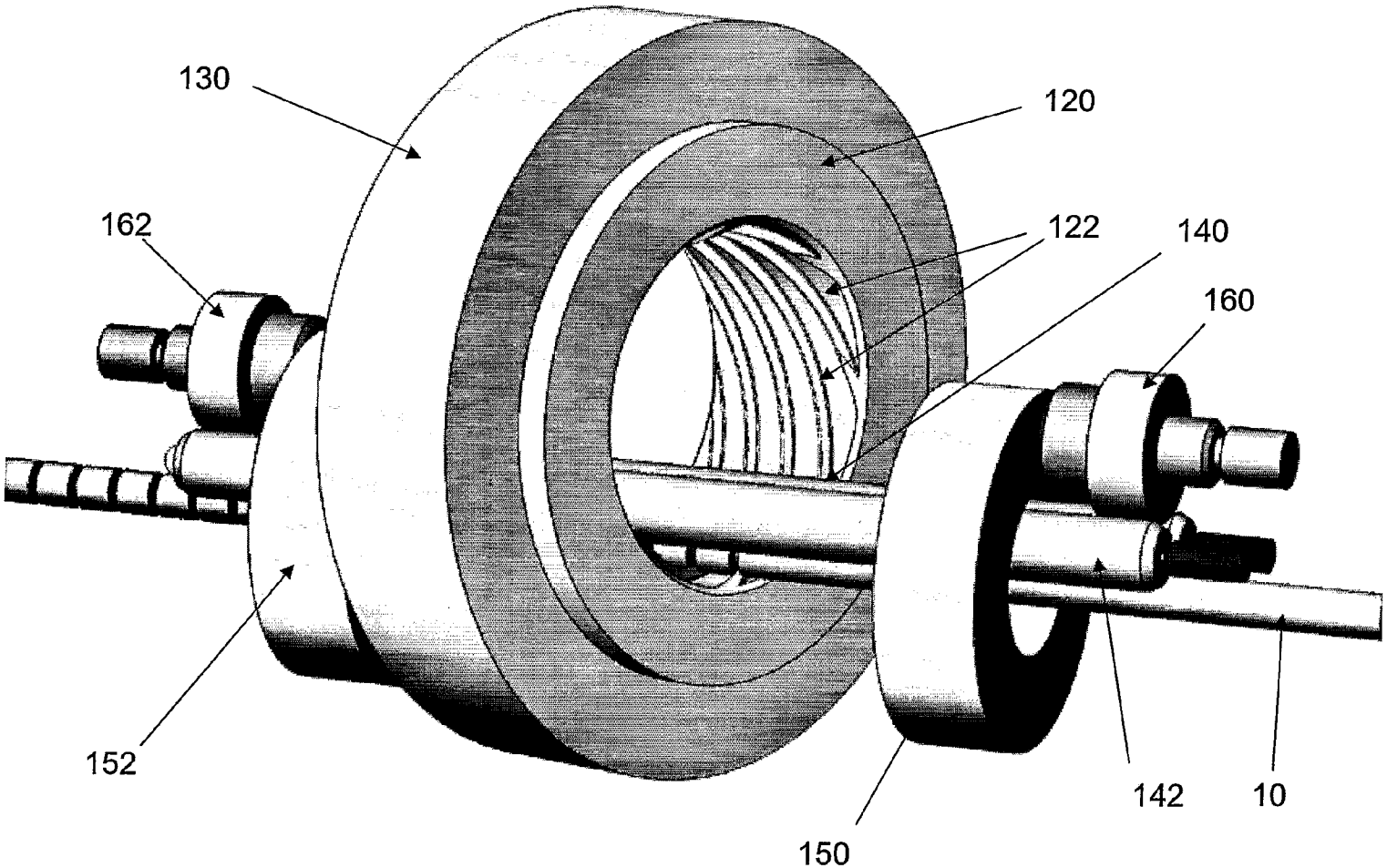
FIG. 3 shows a schematic depiction of a cut-away perspective view of an apparatus according to the present invention.
Figure 4:
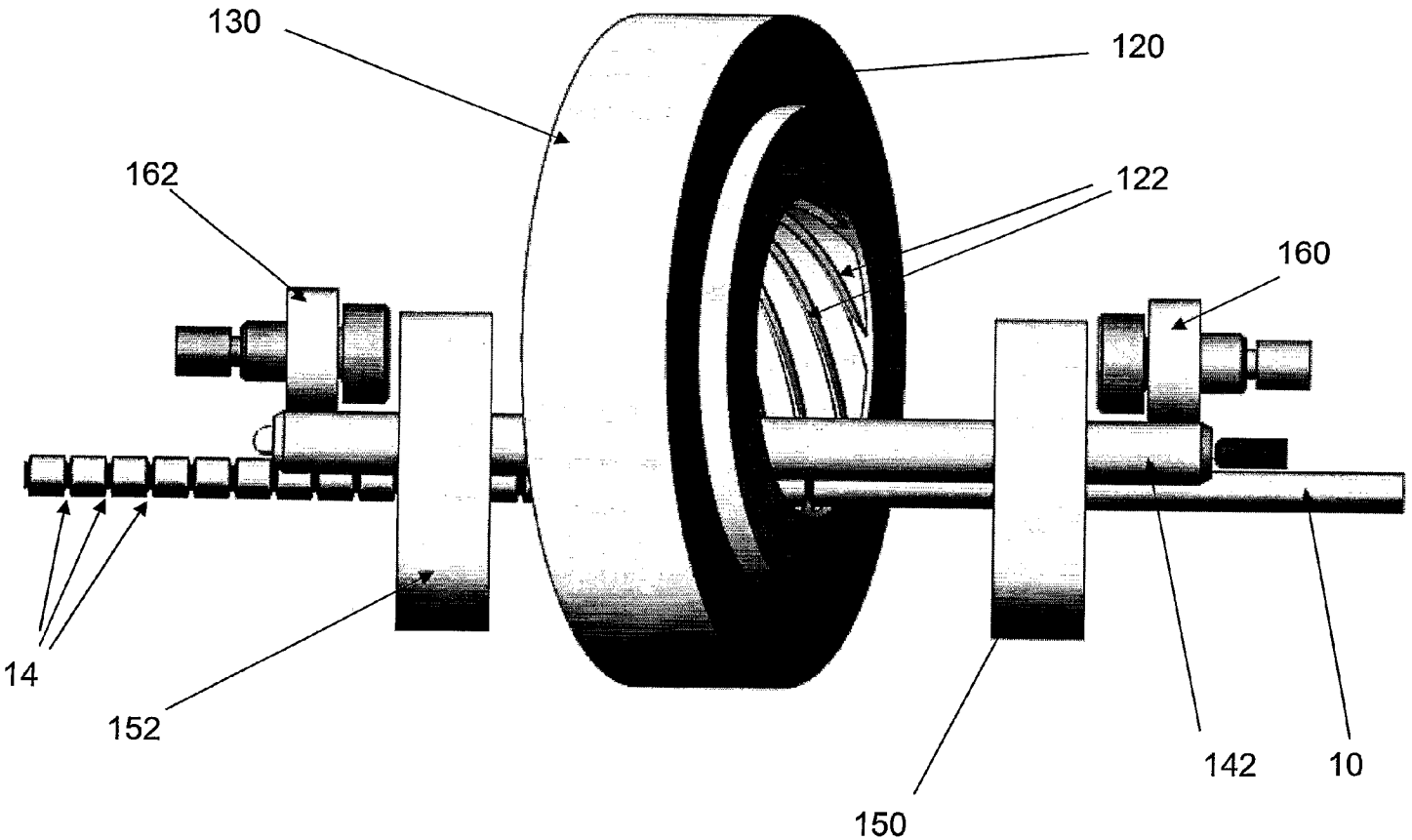
FIG. 4 shows a schematic depiction of a cut-away side view of an apparatus according to the present invention.

FIGS. 1 to 4 show a schematic depiction of an apparatus 100 according to the present invention: FIG. 1 shows a cross-section of the apparatus; FIG. 2 shows a cut-away axial view of the apparatus; FIG. 3 shows a cut-away perspective view of the apparatus; and FIG. 4 shows a cut-away side view of the apparatus.

The apparatus 100 comprises a rotatable cylindrical cutter 120, which is received within and coupled to a cutter bearing 130. The inner surface of the rotatable cylindrical cutter comprises a plurality of cutting edges 122. Received within the interior of the rotatable cylindrical cutter are first and second positioning rollers 140 & 142. which extend beyond either end of the rotatable cylindrical cutter. First and second positioning bearings 150 & 152 are provided at the first and second ends of the first and second positioning rollers, the first and second positioning bearings being located outside of the rotatable cylindrical cutter. The first and second positioning bearings are configured such that they are in contact with the outer surface of both the first and second positioning rollers. There is also provided first and second control rollers 160, 162, that are received outside of the rotatable cylindrical cutter and are configured to retain contact with both of the first and second positioning rollers. First and second control bearings 170, 172 are provided to enable the first and second control rollers to be rotated. A housing 180 is provided to receive these components. The housing may comprise a plurality of components that interconnect to form the housing. The housing may comprise connection means 200 to enable the apparatus to be connected to a headstock to enable rotational motion to be provided to the apparatus.

In use, a linear member 10, for example a tube made from a plastics material having a hollow centre 12, is received within the apparatus and is processed to form a plurality of grooves 14 in the outer surface of the tube. When a tube is received within the apparatus, its longitudinal axis is parallel with the longitudinal axes of the first and second positioning rollers. The rotatable cylindrical cutter is aligned so as to be offset with respect to the common longitudinal axis of the tube and the first and second positioning rollers.

As is well-known, the formation of the plurality of grooves 14 improves the resistance of the tube to excessive bending forces and this is of particular benefit when an optical fibre is received within the tube. A tube 10 which is received within the rotatable cylindrical cutter is urged against the interior of the cylindrical cutter by the first and second positioning rollers. The position of the first and second positioning rollers is maintained by the first and second control rollers which prevent the first and second positioning rollers from losing contact with the tube. The rotation of the cutter bearing causes the cylindrical cutter to be rotated, such that the cutter is rotated around the outside of the tube. The rotation of the cutter around the tube, in combination with the urging of the tube against the inner surface of the cutter by the first and second positioning rollers causes the cutting edges 122 to form grooves in the outer wall of the tube. The motion of the cutting edges also acts to advance the tube through the apparatus. It will be noted that the cutting edges comprise a substantially helicoidal geometry such that the grooves that are formed in the tube are circumferential.

The angle of the rotatable cylindrical cutter with respect to the common longitudinal axis of the tube and the first and second positioning rollers may be within the range of 5° to 40° but it has been observed that the optimum value is in the range of 20°-30° and that a preferred value is substantially 25°.

A further advantage of the present invention is that the cutter may accommodate a wide range of tube diameters and this will reduce the time taken to change production from a first diameter of tube to a second diameter of tube. For the production of tubes which are to receive optical fibres, which will typically have an outer diameter of 1 to 10 mm, then it is believed that this size range can be readily produced using the same cutter. It will be understood that the separation of the first and second positioning rollers from the interior wall of the cylindrical cutter will vary with the outer diameter of the tube. Accordingly, the apparatus may allow the position of the first and second positioning rollers to be varied in order to accept a tube of a given diameter. Alternatively, the first and second positioning rollers may be replaced with positioning rollers having different diameter to accommodate the tube. The positioning and or size of the control rollers must also be variable in order to retain the contact between the first and second positioning rollers and the first and second control rollers.

The apparatuses disclosed in our earlier applications (EP 765 214 and GB 0421439.1) operate under a different principle, namely that individual cutters are rotated on bearings around the outside of the tube in which the grooves are to be formed. A consequence of this is that it necessitates the use of small bearings which are not suited to prolonged operation at high speeds. The present invention allows the rotatable cylindrical cutter to be rotated using a significantly larger bearing which is capable of prolonged operation at high speeds (for example 10 000 rpm and greater) due to its greater size and because it is possible to pump oil into the bearing to provide lubrication. The oil may be cooled in order to regulate the temperature of the bearing.

Furthermore, the known methods described in EP 765 214 and GB 0421439.1 require more than one rotation of the cutters to form a single groove in the exterior of the tube. In the present invention, the cutter provides a plurality of cutting edges such that a single rotation of the cutter causes s plurality of grooves to be formed in the tube.

It is believed that due to the combination of these effects the use of an apparatus according to the present invention should enable tubing to be manufactured and processed to form grooves at a rate of 100 meters per minute, which is substantially greater than the 20-30 meters per minute that can be sustained using conventional techniques.

FIG. 5*a* shows a schematic depiction of a perspective view of a first embodiment of cylindrical cutter 120 and FIG. 5*b* shows a schematic depiction of a cross-sectional view of cylindrical cutter 120. The cylindrical cutter comprises a plurality of cutting edges 122 that are disposed at an angle to the axis of the cutter. Preferably, the inner surface of the cylindrical cutter has a curved inner surface 124. As described above, the cylindrical cutter is rotationally offset with regard to the axis of the tube and the first and second positioning rollers.

If the longitudinal axis of the cylindrical cutter were to be parallel to that of the tube then a tube received within the cylindrical cutter would have a continuous line of contact with the cylinder (assuming that the action of the positioning rollers causes the cutting edges to be received within the wall of the tube). By rotating the cylindrical cutter relative to the tube, there is no longer a line of contact between the cutter and the tube, but instead there will be two separate points of contact separated by a region for which there is a gap between the tube and the surface of the cutter. Given the rotational offset between the cutter and the tube it is possible to calculate the position of the tube relative to the cutter and modify the shape of the internal surface of the cutter such that there is either a continuous line of contact between the tube and the cutter or a shorter separation between the two separate points of contact between the tube and the cutter. It will be appreciated that the number of cutting edges in the cutter is of no significance to the operation of the present invention but it is thought that 6-10 cutting edges is a suitable range as it provides the efficiency of the present invention by allowing multiple grooves to be formed with a single rotation of the cutter without causing unnecessary complication in the manufacture or the operation of the cutter.

FIG. 6 shows a schematic depiction of a further embodiment of cylindrical cutter 220 that comprises a plurality of cutting elements 226; FIG. 6*a* shows a perspective view of a single cutting element 226; FIG. 6*b* shows a schematic depiction of a perspective view of cylindrical cutter 220 formed from a plurality of cutting elements 226 and FIG. 6*c* shows a schematic depiction of a cross-sectional view of cylindrical cutter 220 formed from a plurality of cutting elements 226. Preferably each of the cutting elements comprises an entire cutting edge although it will be understood that one or more cutting elements may be combined to form a single cutting edge. Although FIG. 6*c* shows that the interior surface of the cutter is parallel to the longitudinal axis of the cutter, it will be understood that the inner surface of the cutter may be curved, in a similar manner to that shown n FIG. 5*b*.

It has been found that the grooves in the tube are best formed when more than one cutting edge is used to form the groove. This can be achieved by appropriate spacing of the cutting edges in the cylindrical cutter so that a subsequent cutting edge will fall into the groove formed by a previous cutting edge. Preferably each of the cutting edges in the cylindrical cutter has a length that is substantially equal to the circumference of the tube such that each cutting edge forms an entire groove.

The invention claimed is:

1. An apparatus for forming a plurality of grooves in an outer surface of an elongate member, the apparatus comprising:

a cylindrical cutter having a longitudinal axis, an internal surface of the cylindrical cutter comprising a plurality of cutting means;

first and second rotatable positioning means, the first and second rotatable positioning means configured, in use, to hold the elongate member against the internal surface of the cylindrical cutter;

the cylindrical cutter being received within a cutter rotation means such that the rotation of the cutter rotation means causes the cylindrical cutter to rotate, the rotation of the cylindrical cutter, in use, causing the first and second rotatable positioning means and the elongate member held against the internal surface of the cylindrical cutter to rotate relative to the internal surface of the cylindrical cutter such that the elongate member is advanced through the cylindrical cutter and the plurality of cutting means form a plurality of grooves in the outer surface of the elongate member, wherein, the apparatus further comprises a rotatable control means, the rotatable control means being in contact with both the first and second rotatable positioning means.

2. An apparatus according to claim 1, wherein the rotatable control means comprises first and second control rollers, the first control roller being located in contact with the first and second rotatable positioning means near a first end of the first and second rotatable positioning means and the second control roller being located in contact with the first and second rotatable positioning means near a second end of the first and second rotatable positioning means.

3. An apparatus according to claim 1, wherein the apparatus further comprises one or more control rotation means, the or each control rotation means being configured to, in use, rotate the rotatable control means.

4. An apparatus according to claim 1, wherein the cutting means are inclined at an angle to the longitudinal axis of the cylindrical cutter.

5. An apparatus according to claim 4, wherein the cutting means are inclined at an angle of between 10° and 40° relative to the longitudinal axis of the cylindrical cutter.

6. An apparatus according to claim 4, wherein the cutting means are inclined at an angle of substantially 25° relative to the longitudinal axis of the cylindrical cutter.

7. An apparatus according to claim 1, wherein the cylindrical cutter comprises a plurality of cutting elements, each of the plurality of cutting elements comprising one cutting means.

8. An apparatus according to claim 1, wherein the internal surface of the cylindrical cutter is arcuate.

9. An apparatus according to claim 1, wherein the cylindrical cutter is rotationally offset with respect to an axis of the first and second rotatable positioning means and the elongate member received within the apparatus.

10. An apparatus according to claim 2, wherein the apparatus further comprises one or more control rotation means, the or each control rotation means being configured to, in use, rotate the rotatable control means.

11. An apparatus according to claim 5, wherein the cutting means are inclined at an angle of substantially 25° relative to the longitudinal axis of the cylindrical cutter.

* * * * *